US006843008B2

(12) United States Patent
Mellgren

(10) Patent No.: US 6,843,008 B2
(45) Date of Patent: Jan. 18, 2005

(54) DEVICE FOR MARKING OF WIRES AND CONDUITS

(75) Inventor: Gunnar Mellgren, Gullspång (SE)

(73) Assignee: Partex Marking Systems AB, Gullspang (SE)

( * ) Notice: Subject to any disclaimer, the term of this patent is extended or adjusted under 35 U.S.C. 154(b) by 10 days.

(21) Appl. No.: 10/332,461

(22) PCT Filed: Aug. 7, 2001

(86) PCT No.: PCT/SE01/01716

§ 371 (c)(1),
(2), (4) Date: Jan. 9, 2003

(87) PCT Pub. No.: WO02/13207

PCT Pub. Date: Feb. 14, 2002

(65) Prior Publication Data

US 2004/0098890 A1 May 27, 2004

(30) Foreign Application Priority Data

Aug. 8, 2000 (SE) ..... 0002848

(51) Int. Cl.[7] ..... G09F 3/00
(52) U.S. Cl. ..... 40/316; 174/112
(58) Field of Search ..... 40/316, 660, 666; 174/112; D13/157

(56) References Cited

U.S. PATENT DOCUMENTS 3,487,574 A * 1/1970 Loof ..... 40/316
4,876,810 A 10/1989 Piana et al.
5,275,282 A * 1/1994 Ross et al. ..... 206/389
6,237,263 B1 * 5/2001 Hagstrom et al. ..... 40/316

FOREIGN PATENT DOCUMENTS

| | | | | |
|---|---|---|---|---|
| CH | 607245 A | | 11/1978 | |
| DE | 92113508 U1 | | 1/1993 | |
| EP | 0875970 A2 | | 11/1998 | |
| FR | 2667426 A1 | | 4/1992 | |
| GB | 1216228 | * | 12/1970 | ..... 40/316 |
| WO | WO-87/05740 | * | 9/1987 | ..... 40/316 |
| WO | WO-89/11153 | * | 11/1989 | ..... 40/316 |

* cited by examiner

*Primary Examiner*—Brian K. Green
(74) *Attorney, Agent, or Firm*—Sughrue Mion, PLLC

(57) ABSTRACT

Marking sleeve for marking wires or pipes in the form of an annular or sleeve-shaped body manufactured in one piece and made of an elastic material. The marking sleeve is intended to bear one or more marking symbols and includes a yoke-shaped outer part with two outer legs which serve as side walls. At their lower ends, these legs merge with an inner yoke-shaped outer part, which extends up between the legs, with two inner legs and a web portion joining the upper ends of these. This web portion, together with the surrounding yoke-shaped outer part, delimits a tunnel-shaped passage for a wire which is to be marked. The outer surface of each of the outer legs is made with at least one longitudinal groove, and the mutually facing surfaces of each of the inner legs are made with at least one longitudinal groove.

5 Claims, 3 Drawing Sheets

DEVICE FOR MARKING OF WIRES AND CONDUITS

TECHNICAL FIELD

The present invention relates to an arrangement for marking wires or pipes, in particular electric wires, in the form of an annular or sleeve-shaped body manufactured in one piece and made of an elastic material, preferably plastic, which body is intended to bear one or more marking symbols and comprises a yoke-shaped outer part with two outer legs which serve as side walls and, at their lower ends, merge with an inner yoke-shaped part, which extends up between the legs, with two inner legs and a web portion joining the upper ends of these together, which portion, together with the surrounding yoke-shaped outer part, delimits a tunnel-shaped passage for a wire or a pipe which is to be marked.

BACKGROUND OF THE INVENTION

Arrangements of this type, which may also be referred to as marking sleeves, have long been used for marking in particular electric wires and cables, but are also used for marking pneumatic and hydraulic pipes.

By virtue of the inner yoke-shaped part, the web portion of which forms a support for a wire which is guided through the marking sleeve, a number of bellows-like folds are formed, which afford an expansion possibility for the sleeve. One and the same marking sleeve can then be used for wires of diameters which vary within a given range. It is therefore possible to cover a diameter range from roughly 1 mm to roughly 16 mm by using marking sleeves of four standard sizes.

The marking sleeves can either be made in the form of relatively small rings, each intended to bear a marking symbol, a number of rings then being positioned next to one another on a wire so as to bring about a sequence of a number of marking symbols, or alternatively the marking sleeve can be made of greater length, in which case one and the same sleeve can bear a sequence of marking symbols.

The marking symbols can either be printed directly onto the upper part of the sleeve, which part connects the upper edges of the outer legs of the sleeve, or alternatively be printed on separate labels which are inserted into an upper, longitudinal pocket of the sleeve. The sleeves are suitably manufactured by extrusion of a relatively soft plastic material.

Marking sleeves of the type indicated above, which are each to be capable of being used on wires of different diameters, should have two characteristics, which can be difficult to combine. The first characteristic is that the sleeves, after they have been threaded onto a wire from one of its ends, are to be secured in the desired position without risk that they will rotate on the wire or be displaced along it, which requires good friction. The second characteristic, which is difficult to combine with the first, is that the sleeves are to be easy to thread onto a wire, that is to say the friction between the sleeve and the wire is to be as low as possible during threading-on. This applies particularly in the case of longer sleeves.

THE OBJECT OF THE INVENTION

One main object of the present invention is to produce a marking sleeve of the type described above, which retains the capacity of previous sleeves for being secured in the desired position on a wire but which is easier to thread onto the wire than those previously known.

The invention is based on the insight that this can be achieved by virtue of the fact that the marking sleeve is made with weakened portions which serve as hinges and facilitate deformation of the sleeve during threading onto a wire but do not appreciably affect the grip on the wire, when the sleeve has taken up the desired position on the wire.

According to the present invention, the particularly characteristic feature of an arrangement of the type indicated in the first paragraph is then that the outer surface of each of the outer legs is made with at least one longitudinal groove, and that the mutually facing surfaces of each of the inner legs are made with at least one longitudinal groove, which grooves form deformation indications which facilitate deformation of the annular or sleeve-shaped body, when a wire or a pipe is guided through the tunnel-shaped passage.

By virtue of the fact that deformation of the marking sleeve is facilitated, its threading onto a wire is simplified, while the elasticity in the material still brings about a secure grip on the wire when the sleeve has been guided into place. Owing to the fact that the deformation indications are made in the form of longitudinal grooves, manufacture of the sleeve by extrusion is not made more difficult.

In order to facilitate pressing-down of the inner yoke-shaped part in the sleeve, which part serves as a support, the rounded transition between each outer and inner leg is suitably made with a longitudinal groove on the outside of the rounded portion. A groove is preferably also arranged on each side of the rounded portion essentially at the transition between this and the respective leg.

In an especially preferred embodiment, each of the outer legs is moreover provided with a longitudinal groove essentially in the middle of the leg and a longitudinal groove along the upper edge of the leg, and the mutually facing surfaces of the inner legs are each provided with a longitudinal groove along the upper edge of the respective leg.

The invention will be described in greater detail below with reference to the embodiments shown by way of example in the accompanying drawings.

BRIEF DESCRIPTION OF THE FIGURES IN THE DRAWINGS

DETAILED DESCRIPTION OF PREFERRED EMBODIMENTS

Figure 1:
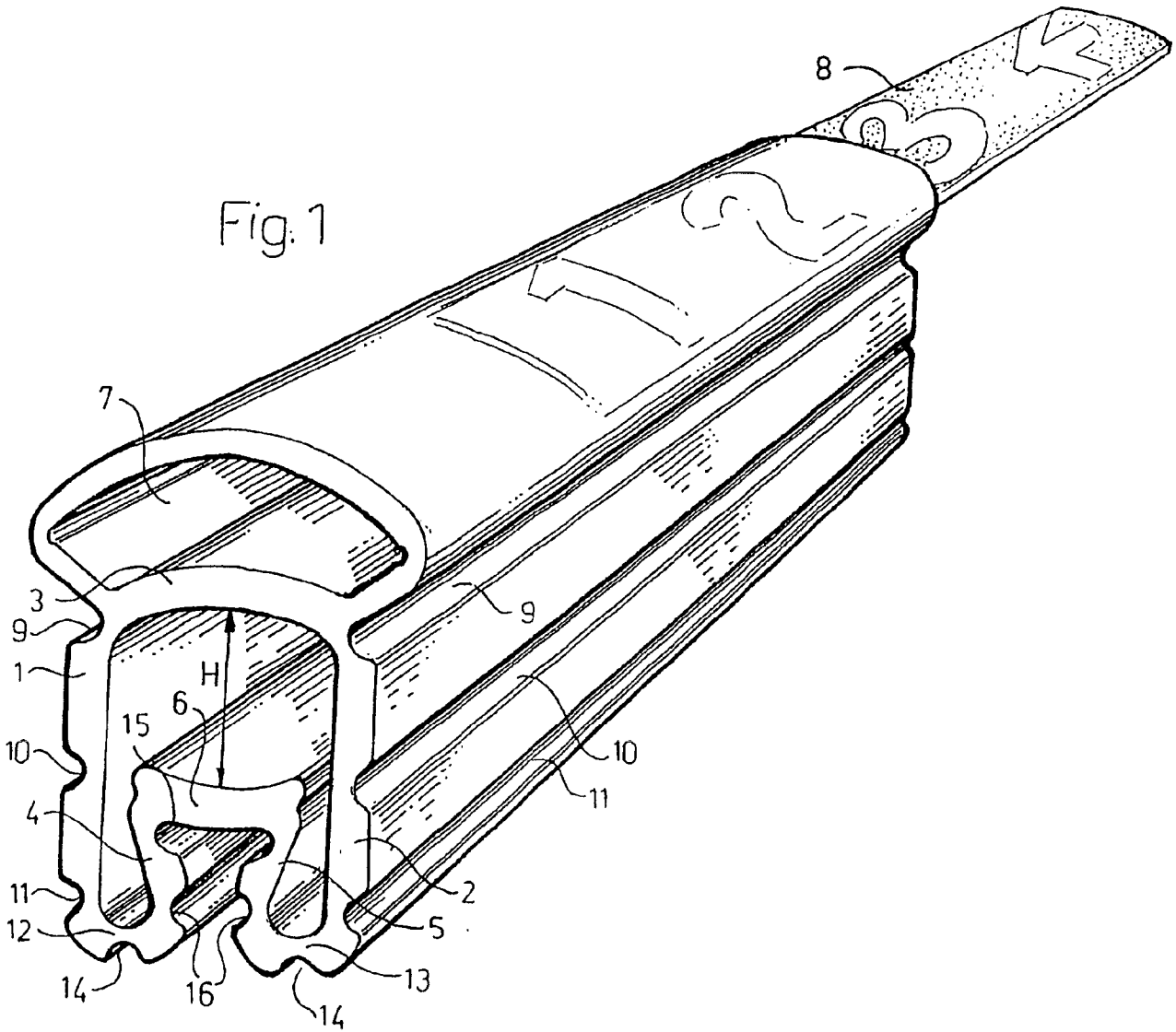
FIGS. 1 and 2 show two embodiments of a marking sleeve according to the invention.
Figure 2:
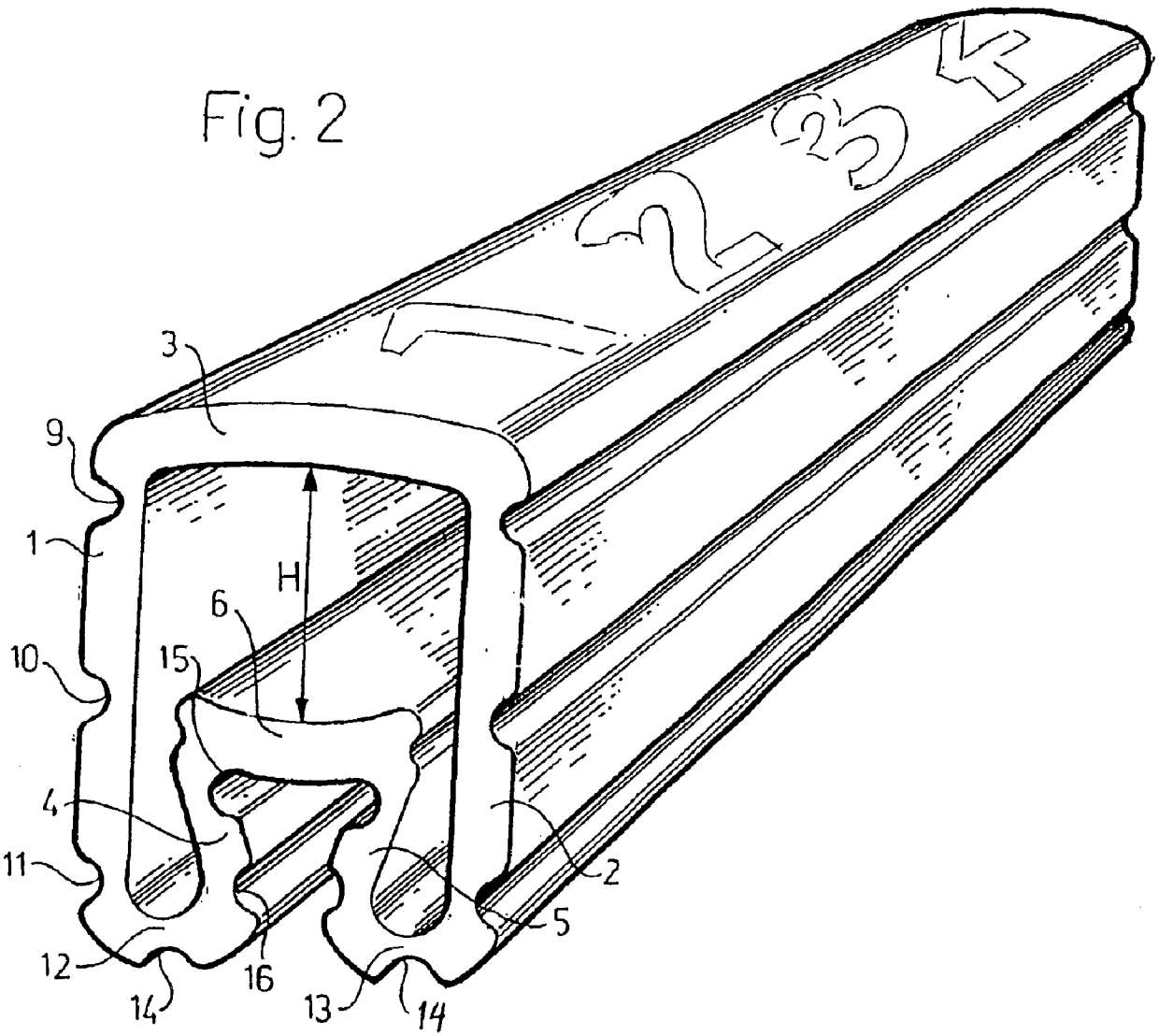

FIGS. 1 and 2 show two examples of marking sleeves, the general shape of which is previously known. They are extruded in a relatively soft plastic material and each comprise a yoke-shaped part with two side walls 1, 2, which are joined together at their upper ends via a web portion 3. At their lower ends, the outer legs merge with an inner yoke-shaped part, which extends up between the legs, with two inner legs 4, 5 and a web portion 6 joining the upper ends of these together. This portion, together with the surrounding yoke-shaped outer part, forms a tunnel-shaped passage of a height H for a wire onto which the sleeve is to be threaded. In this connection, the web portion 6 forms a bottom support for the wire.

The sleeve according to FIG. 1 is made with a longitudinal pocket 7 which extends above the web portion 3 and is intended to receive a marking label 8 provided with the desired marking symbols.

In the embodiment according to FIG. 2, the marking symbols are intended to be printed directly onto the web portion 3.

Marking sleeves according to FIGS. 1 and 2 can be used for wires of diameters lying within a given range, the inner yoke-shaped part forming a number of expansion folds of the profile. These allow the web portion 6 to be pressed downward by a wire end of a diameter greater than the height H of the passage through the marking sleeve. The outer legs 1 and 2 of the sleeve will then be pressed outward by the wire end.

When a wire which is relatively thick in relation to the area of the tunnel-shaped passage is guided through, appreciable resistance to the wire being guided through can be encountered. The reason for this is inter alia that the wire end has to "plough its way" through the sleeve, the relatively soft material of which is pressed outward only directly in front of the end of the wire.

In order to facilitate guiding-through of the wire, a sleeve according to the invention is, as illustrated in FIGS. 1 and 2, made with a number of longitudinal grooves which form deformation indications which facilitate deformation of the sleeve in connection with threading onto a wire. By making use of such longitudinal grooves, it has been possible to establish that the material of the sleeve in front of the wire end tends to be pressed outward further in front of the wire end than in the case of a sleeve which has no grooves. This means that the friction forces in particular toward the front portion of the wire are reduced, which facilitates threading-on.

FIGS. 1 and 2 show an embodiment which is preferred according to the invention, in which the outer legs 1 and 2 are each provided with three longitudinal grooves 9, 10 and 11, of which the groove 10 runs essentially along a center line of each leg, while the other two grooves 9 and 11 run along the upper and, respectively, lower edge of each leg. The outer legs 1 and 2 merge with respective inner legs 4, 5 via rounded portions 12, 13 which each have a longitudinal groove 14 along their lower part. The inner legs 4, 5 are each provided with two grooves on the mutually facing surfaces, which grooves run along the upper and, respectively, lower edge of each leg.

Figure 3:
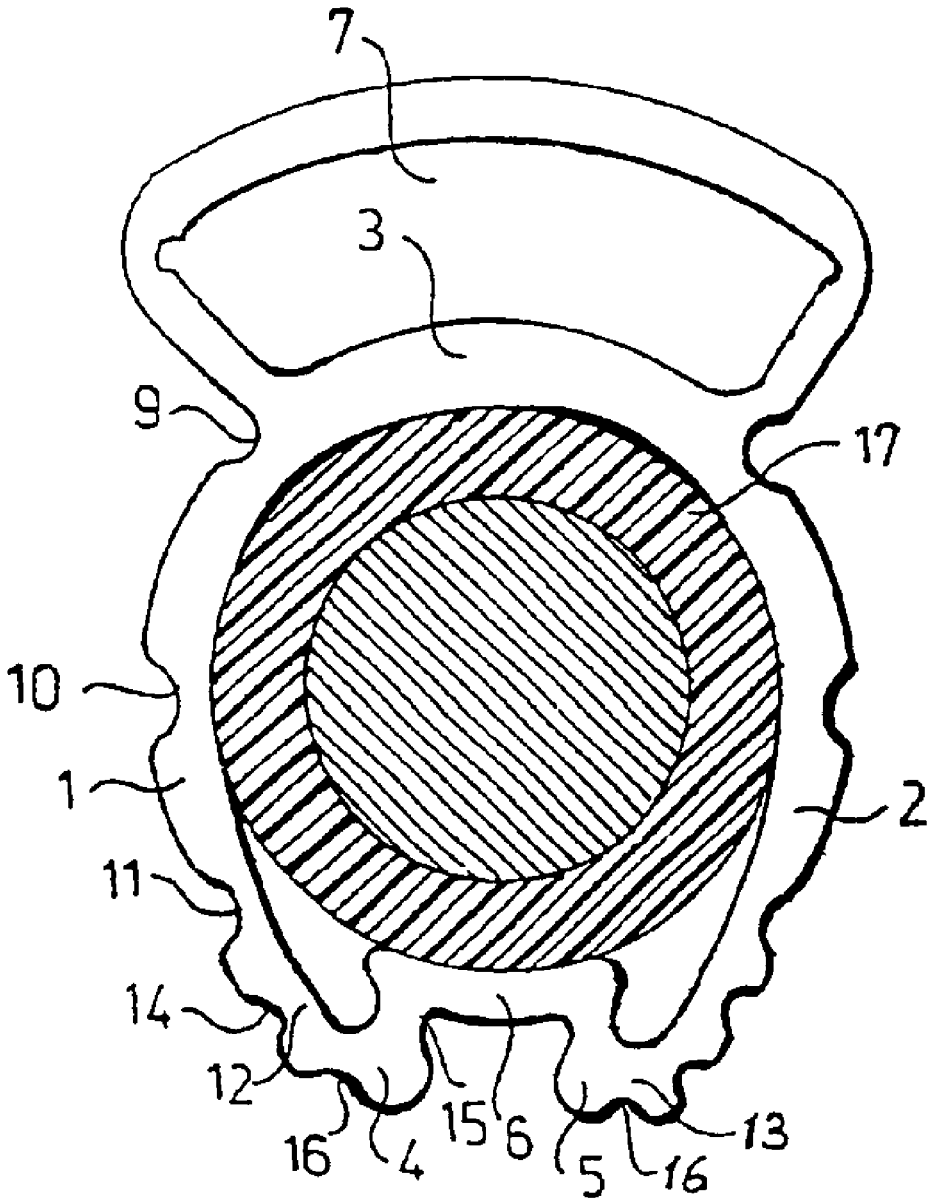
FIG. 3 is an end view of the marking sleeve according to FIG. 1 during its threading onto a wire.

FIG. 3 shows a marking sleeve according to FIG. 1 during threading onto a wire 17 of a diameter which is considerably greater than the height H of the passage through the sleeve. In this connection, as can be seen, the inner yoke-shaped part with its web portion 6, which serves as a support surface for the wire, has been pressed downward while the outer legs 1, 2 of the sleeve have been bent out. By means of the grooves shown, this deformation of the sleeve is simplified, and a shape well adapted to the wire 17 is obtained in the deformed state as well. Even a wire of the diameter shown can therefore be pushed through the marking sleeve relatively easily, at the same time as the sleeve will be secured firmly on the wire after it has been guided into the desired position.

The embodiment shown comprises a number of grooves in the various legs. An appreciable effect can nevertheless already be obtained with a smaller number of grooves. It is therefore possible to make use of a groove which runs essentially centrally on each leg and is suitably complemented by a groove in each of the rounded portions which interconnect the respective pairs of legs.

The exact shape of the grooves and also their positioning can be varied as desired as long as they perform the function of bringing about weakenings which serve as deformation indications and facilitate threading of the sleeve onto a wire but do not appreciably worsen the grip around the wire, when the sleeve is located in the desired position on it.

What is claimed is:

1. An arrangement for marking wires or pipes comprising an annular or sleeve-shaped body manufactured in one piece and made of an elastic material, wherein:

the body is intended to bear one or more marking symbols;

the body comprises a yoke-shaped outer part with two outer legs serving as side walls and having lower ends that merge with an inner yoke-shaped part;

the inner yolk-shaped part extends up between the two outer legs, and comprises two inner legs and a web portion joining upper ends of the two inner legs together, the web portion, together with the yoke-shaped outer part, delimits a tunnel-shaped passage for a wire or a pipe which is to be marked;

an outer surface of each of the outer legs comprises at least one longitudinal groove;

mutually facing surfaces of each of the inner legs comprise at least one longitudinal groove;

the grooves form deformation indications which facilitate deformation of the annular or sleeve-shaped body, when the wire or the pipe is guided through the tunnel-shaped passage; and a transition between each outer and inner leg is rounded, and a longitudinal groove runs on an outer surface of each respective rounding.

2. The arrangement as claimed in claim 1, wherein a longitudinal groove runs on each side of the rounding essentially at the transition between the rounding and a respective leg.

3. The arrangement as claimed in claim 1, wherein the at least one longitudinal groove on the outer surface of each of the outer legs comprises a longitudinal groove essentially in the middle of the leg and a longitudinal groove along the upper edge of the leg, and the at least one longitudinal groove on the mutually facing surfaces of each of the inner legs comprises a longitudinal groove along the upper edge of the leg.

4. An arrangement for marking wires or pipes comprising an annular or sleeve-shaped body manufactured in one piece and made of an elastic material, wherein:

the body is intended to bear one or more marking symbols;

the body comprises a yoke-shaped outer part with two outer legs serving as side walls and having lower ends that merge with an inner yoke-shaped part;

the inner yolk-shaped part extends up between the two outer legs, and comprises two inner legs and a web portion joining upper ends of the two inner legs together, the web portion, together with the yoke-shaped outer part, delimits a tunnel-shaped passage for a wire or a pipe which is to be marked;

an outer surface of each of the outer legs comprises at least one longitudinal groove;

mutually facing surfaces of each of the inner legs comprise at least one longitudinal groove;

the grooves form deformation indications which facilitate deformation of the annular or sleeve-shaped body, when the wire or the pipe is guided through the tunnel-shaped passage; and a transition between each outer and inner leg is rounded, and a longitudinal groove runs on each side of each respective rounding essentially at the transition between each respective rounding and a respective leg.

5. The arrangement as claimed in claim 4, wherein the at least one longitudinal groove on the outer surface of each of the outer legs comprises a longitudinal groove essentially in the middle of the leg and a longitudinal groove along the upper edge of the leg, and the at least one longitudinal groove on the mutually facing surfaces of each of the inner legs comprises a longitudinal groove along the upper edge of the leg.

* * * * *